United States Patent [19]

Norton

[11] 4,409,907

[45] Oct. 18, 1983

[54] PORTABLE TREE TABLE

[75] Inventor: Don S. Norton, Clinton, Miss.

[73] Assignee: Brell Mar Products, Inc., Clinton, Miss.

[21] Appl. No.: 270,354

[22] Filed: Jun. 4, 1981

[51] Int. Cl.[3] ..... A47B 5/02

[52] U.S. Cl. ..... 108/152; 182/187; 248/231

[58] Field of Search ..... 108/152, 134, 135, 42; 248/231; 182/9, 187, 188

[56] References Cited

U.S. PATENT DOCUMENTS

| | | | |
|---|---|---|---|
| 1,528,268 | 3/1925 | Schlegel . | |
| 1,722,402 | 7/1929 | Veilleux . | |
| 2,711,783 | 6/1955 | Prill . | |
| 2,967,039 | 1/1961 | Garman | 248/231 |
| 3,030,160 | 4/1962 | Tandy | 108/135 |
| 3,340,828 | 9/1967 | Smith et al. | 108/135 |
| 3,358,789 | 12/1967 | Lann | 108/152 X |
| 3,368,725 | 2/1968 | Martin | 108/152 X |
| 3,613,896 | 10/1971 | Miller, Jr. . | |
| 3,680,235 | 8/1972 | Leemhuis . | |
| 3,927,733 | 12/1975 | Wurn et al. | 182/187 |
| 3,949,835 | 4/1976 | Butler . | |
| 4,022,292 | 5/1977 | Van Gompel . | |
| 4,113,058 | 9/1978 | Kobosl . | |
| 4,124,094 | 11/1978 | Cande . | |
| 4,129,182 | 12/1978 | Hunter | 108/152 X |

*Primary Examiner*—William E. Lyddane

*Attorney, Agent, or Firm*—Cushman, Darby & Cushman

[57] ABSTRACT

The present invention provides a portable tree table that includes two sub-assemblies: a tree belt and bracket assembly, and a table assembly. In use, the tree belt is first tightened about a tree to dispose the bracket at the desired height and adjusted. Then the table assembly is mounted to the bracket. Further adjustments are then made, including extending against the tree and securing stabilizing braces. Disassembly calls for a reversal of these procedures. It is easy to bring in the table and leave the bracket attached to the tree for instances where the table is to be put back up again shortly. Thus there is provided a steady, level work surface easily and securely mounted at a desired height, with no harm to the tree.

17 Claims, 6 Drawing Figures

PORTABLE TREE TABLE

BACKGROUND OF THE INVENTION

One problem often encountered when camping, fishing, hunting, picknicking and cooking-out is where to set things down to use them or to work on them: where to clean a fish, where to set the cooking stove, where to lay-out your tools while working on an outdoor project. Sometimes a card table or camp table will suffice, but generally these are not built for stand-up jobs. If they were, their legs would be too wobbly to provide the steady, level work surface that often spells the difference between enjoyably completing a task, and being so frustrated and unsettled that the task is no fun.

SUMMARY OF THE INVENTION

The present invention provides a portable tree table that includes two sub-assemblies: a tree belt and bracket assembly, and a table assembly. In use, the tree belt is first tightened about a tree to dispose the bracket at the desired height and adjusted. Then the table assembly is mounted to the bracket. Further adjustments are then made, including extending against the tree and securing stabilizing braces. Disassembly calls for a reversal of these procedures. It is easy to bring in the table and leave the bracket attached to the tree for instances where the table is to be put back up again shortly. Thus there is provided a steady, level work surface easily and securely mounted at a desired height, with no harm to the tree.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
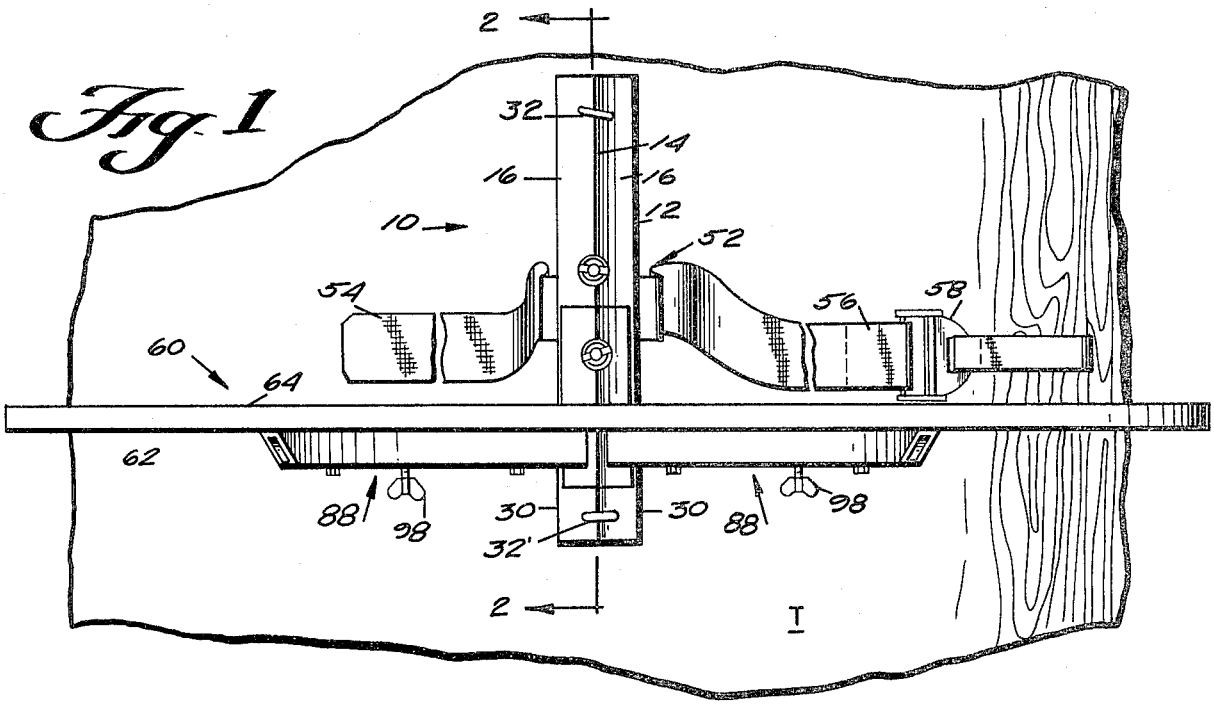
FIG. 1 is a front elevation view of the tree belt and bracket assembly about to be mounted to a tree.
Figure 2:
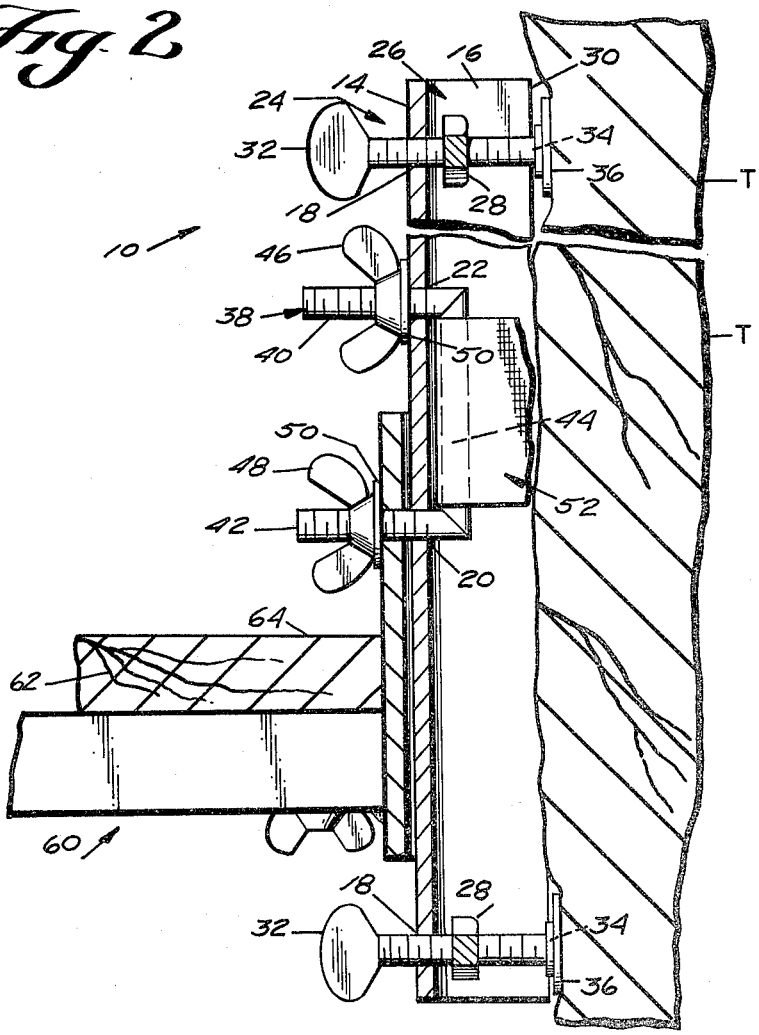
FIG. 2 is a fragmentary longitudinal sectional view taken on line 2—2 of FIG. 1 after the assembly has been mounted to the tree.
Figure 3:
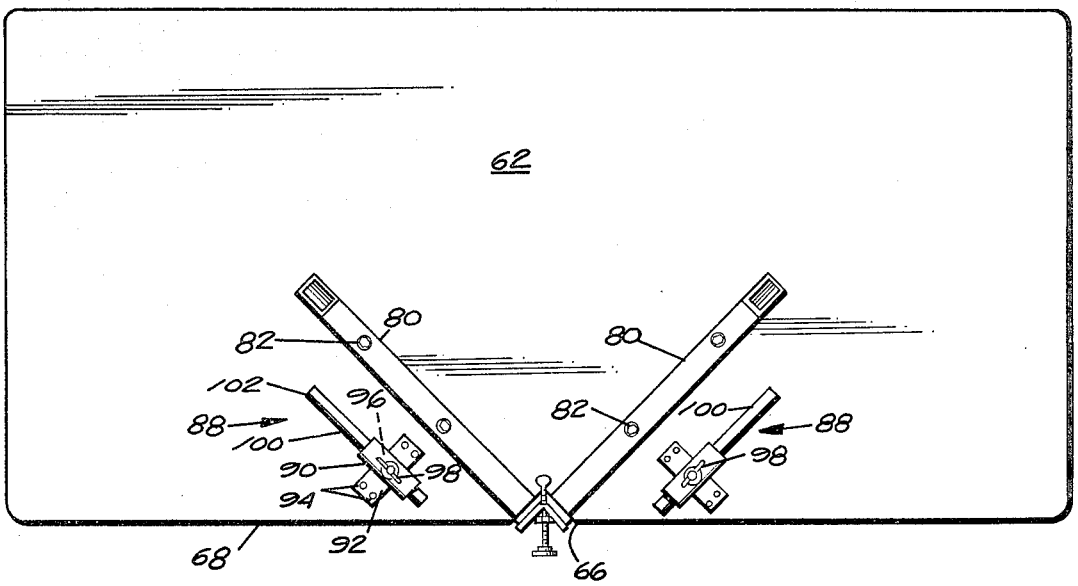
FIG. 3 is a bottom plan view of the table assembly.
Figure 4:
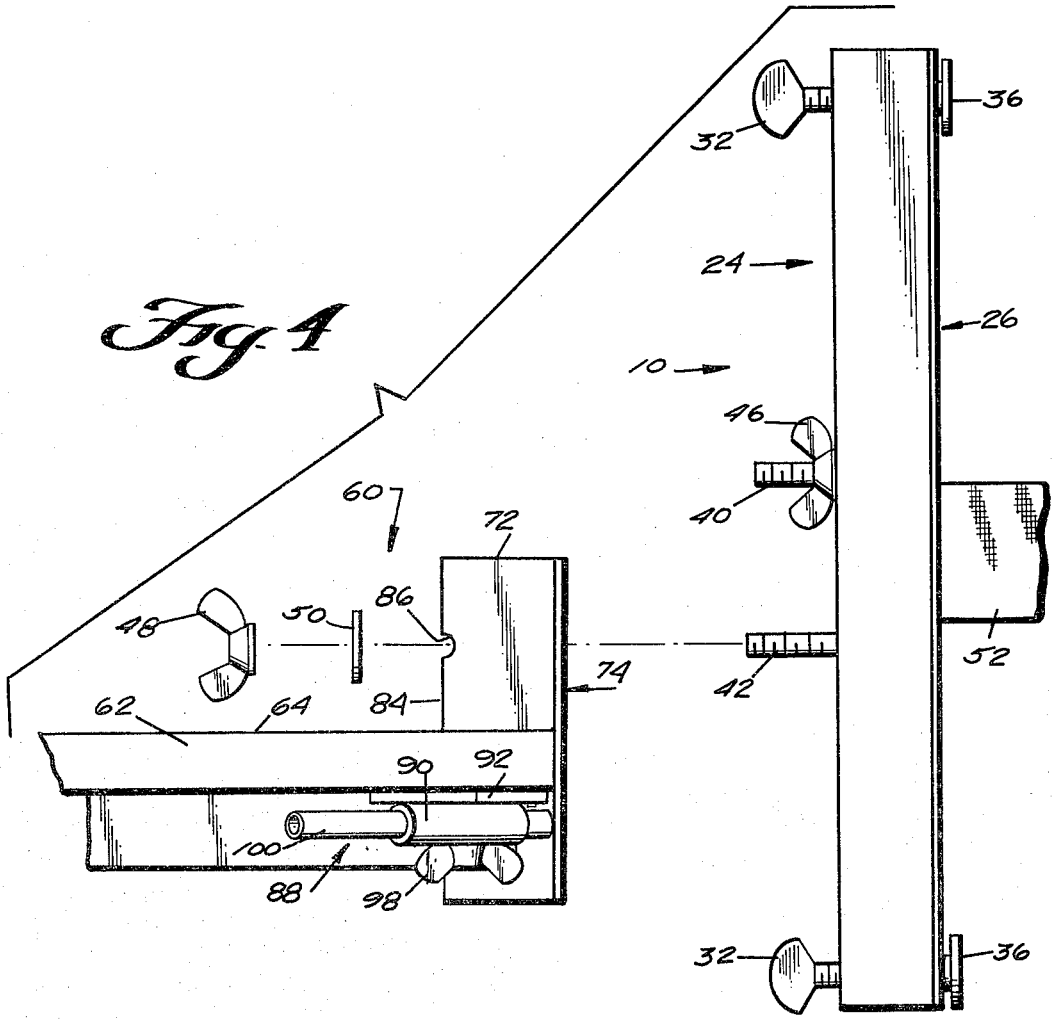
FIG. 4 is an exploded side elevational view showing the table assembly about to be mounted to the tree belt and bracket assembly.
Figure 5:
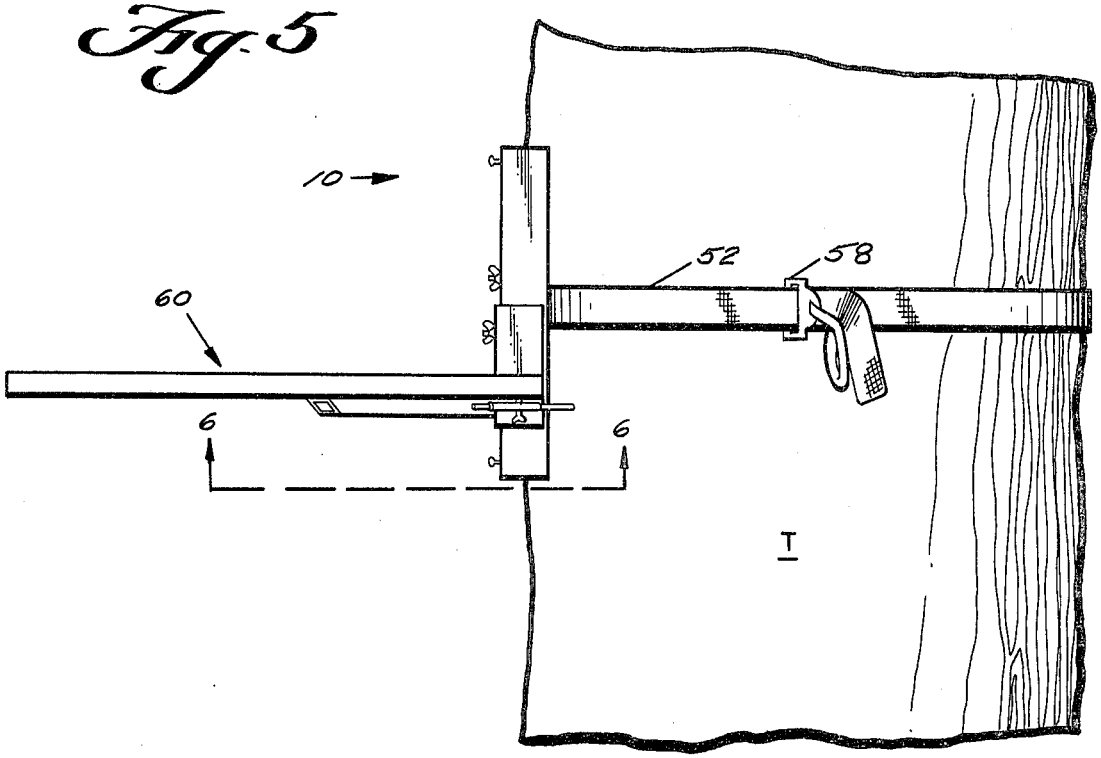
FIG. 5 is a side elevation view of the fully assembled and mounted and adjusted unit.
Figure 6:
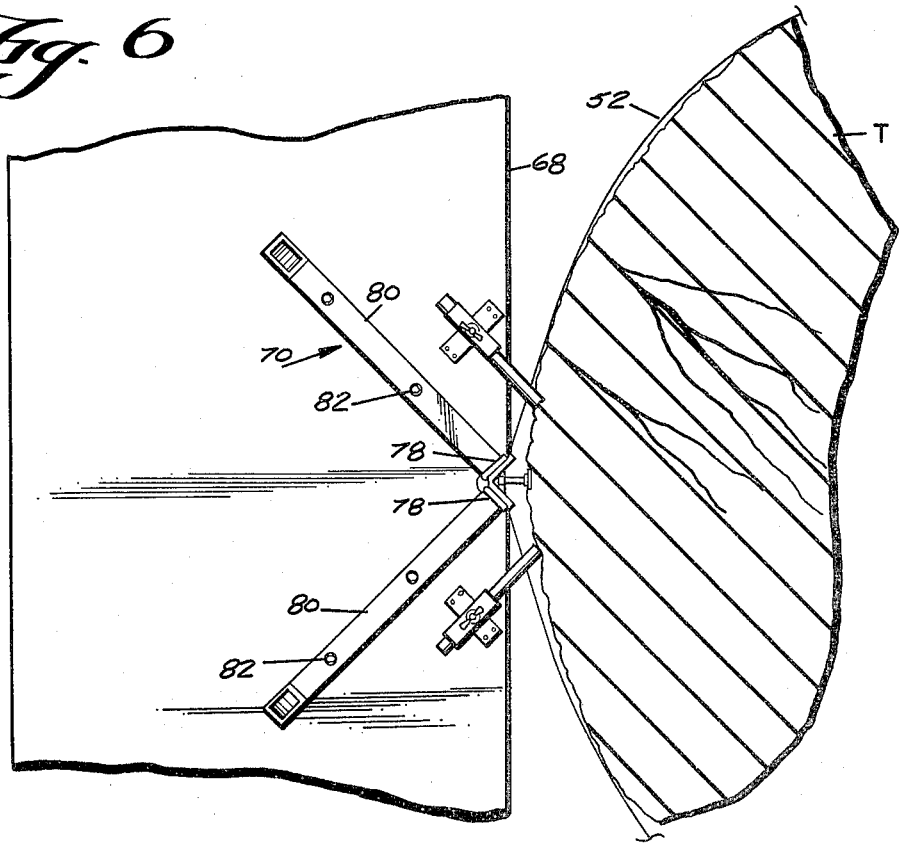
FIG. 6 is a bottom plan view thereof, e.g. a fragmentary transverse sectional view on line 6—6 of FIG. 5.

The tree belt and bracket assembly 10 is shown including a length of channel member of L-shaped transverse cross-section. This bracket 12 is, for instance, about one foot long and may be made of steel, extruded heavy gauge aluminum, or the like. At the longitudinal ridge/trough line 14 of intersection of the two flanges 16 of the bracket 12 four openings are provided, one each at 18 near the upper and lower ends of the bracket and two, e.g. about two and a half inches apart, one above the other at 20, 22 near the halfway point between the upper and lower ends of the bracket. The ridge side 24 of the bracket is the front and the trough side 26 is the rear. Two nuts 28 are secured e.g. by brazing or welding to the trough side of the bracket so that they are respectively in line with the openings 18, but are recessed somewhat back into the trough compared to an imaginary line joining the outer edges 30 of the flanges 16. If the material of the bracket 12 were sufficiently durable, the nuts 28 could be dispensed with and the openings 18 themselves provided with internal threading.

A respective thumbscrew 32 is inserted through each opening 18 from the front and threaded through the respective nut 28 until it protrudes inwardly therethrough. A circumferential groove 34 is formed on the threaded shank of each screw 32 near the free inner end thereof, and a dished annular foot 36 is crimped into this groove 34 so that it is rockable through a few degrees relative to the longitudinal axis of the screw shank and provides an inwardly-presented annular sole surface that is located at least as far inwardly as the free end of the screw shank so the free end of the screw shank does not represent a potentially tree-damaging protrusion. The diameter and thickness of the feet 36 is such that when the thumb screws are unscrewed as far as they will go, the feet 36 lie fully recessed within the trough 26. Conversely, the length of the threaded shanks of the screws 32 is sufficiently long that when the respective screw is threaded all the way in, its foot is disposed substantially beyond the trough 26, e.g. about one inch beyond an imaginary line joining the flange edges 30.

The bracket central openings 20, 22 receive a staple-shaped U-bolt 38 that is installed from the trough side so that its upper and lower threaded legs 40, 42 project horizontally forwardly out of the ridge side of the bracket and its body 44 lies nestled in the trough. Wing nuts 46, 48 are loosely installed by loosely threading them onto the legs after washers 50.

The tree belt and bracket assembly 10 is completed by a tree belt 52 that is slipped between the bracket and U-bolt body until the bracket is located intermediate the ends 54, 56 of the belt. The tree belt 52 preferably is made of automotive seat belt webbing and the ends 54, 56 are formed and provided much like the opposite ends of an automotive seat belt, in that one end can be slipped into or through a fixture 58 on the other and if pulled tight will remain tight until intentionally released, e.g. by pushing a release button or release lever.

The table assembly 60 includes a table member 62. Although more elaborate table members are feasible, the one shown is simply a generally rectangular plate, e.g. made of three-quarter inch marine plywood and measuring about thirty-two inches wide by about sixteen inches deep. In this version, the table member 62 has a simple, planar upper, working surface 64 that is broken only by a V-shaped notch 66 at the center of the rear edge 68 thereof.

To the bottom of the table member 62 there is mounted a bracket fixture 70 which includes a vertically disposed channel member 72, which is of L-shaped transverse section and has its trough side 74 presented rearwardly. To the front side of each flange 76 of the channel member 72, i.e. on the ridge side of the channel member, there is secured e.g. by brazing or welding at 78 the rearmost end of a horizontally disposed rib-like brace 80, each typically constituted by a length of box channel member, which is e.g. one foot long. Thus, the braces 80 extend at right angles to one another in a common horizontal plane. The attachments 78 are located near the lower end of the channel member 72, so that when the fixture 70 is applied against the underside of the table member 62 with the channel member 72 nested in the V-shaped notch 66, the braces 80 extend along the underside of the table member toward its respective front corners. Although the braces could be made to extend all the way to the front of the table member, for general use it is sufficient if they extend so as to support a major portion of the depth and width of the table member.

The bracket fixture is shown secured to the table member e.g. by a plurality of screws 82 installed upwardly through the braces 80 and into the table member. Typically, the channel member 72 extends about two and a half inches above the upper surface of the table member. The thus-exposed portion of the channel member 72 is shown provided along its ridge line 84 with a horizontal opening 86.

The table assembly as shown is completed by two stabilizers 88. Each is shown constituted by a tubular bracket 90 secured to a plate 92 which is screwed at 94 to the underside of the table member laterally outwardly of but beside and oriented so its tube 90 is generally parallel to a respective brace 80, and very near the rear edge of the table member. At its center bottom, each tubular sleeve 90 is provided with a vertically-oriented threaded opening 96 in which is threadedly received a wing-headed set screw 98. A stabilizer bar 100, shown in the from of a section of rigid aluminum tubing is slidingly received in each sleeve 90. When the table assembly is not being used, the normal position of the stabilizer bars 100 is to be retracted so their respective rearmost ends 102 are retracted relative to the rear edge of the table members. Tightening the set screws 98 keeps the selected positions of the stabilizer bars.

In use, the tree belt and bracket assembly 10 first is mounted to a tree T and then the table assembly 60 is mounted to the assembly 10, as follows.

At the location where the table is to be put to use, a suitable tree T (or equivalent pillar, post or the like is selected) and the web belt is wrapped about it at the desired height from the ground. The ends of the web belt are brought together, fastened and pulled tight. This disposes the bracket 12 with its ridge line 14 substantially vertically and with its ridge side presented forwards. At this time if the bracket 12 is not as vertically oriented as its should be, it can be simply shifted by hand.

Next the wing nut 48 and washer 50 are removed from the lower leg 42 of the U-bolt 38 and that leg is slipped through the opening 86 in the channel member 72 of the table assembly.. The washer 50 and nut 48 are reinstalled and tightened, pulling the ridge side of the channel member tightly and securely into the trough side of the bracket 12. At the same time that the nut 48 is tightened, the nut 46 also is screwed tight. This act further tightens the web belt about the tree T, because the body of the U-bolt pulls a little of the belt into the trough side of the channel member 12.

The set screws 98 are then loosened, the stabilizer bars are run-in until the inner end of each firmly engages the tree trunk T and then the set screws 98 are retightened. This prevents the table from tipping side to side. The inner ends of the stabilizer rods are round, to prevent damage to the tree, and in manufacture both ends are simply squashed slightly into oval form and keep them from sliding out of the tubular sleeve even when the set screws are loose.

Lastly, the thumbscrews 32 are run in by the respective amounts needed to level the table in the front-to-back direction.

Thus there is conveniently provided, even at a remote location, an easily transported table that can be installed at any height, for use at sit-down level, at stand-up level or even way up in a tree to provide more working room, e.g. for a hunter who is also using a tree stand. The table member of this unit can be mounted and demounted from the tree while leaving the support bracket strapped to the tree, if desired, and its use will not harm the tree. The levelers, stabilizers and tighteners all can be fastened, unfastened and tightened without the use of tools. The nesting of two channel irons in mounting the table assembly to the tree belt and bracket assembly provides a very strong and steady mounting means with ease. The novel stabilizers provide both strength for the cantilevered table top and insurance against side-to-side tipping of the table top.

It should now be apparent that the portable tree table as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A portable tree table, comprising:

a bracket;

belt means having means for connecting the bracket therewith; said belt means being constructed and arranged to be tightly secured together about a tree trunk at any selected height, to thereby securely, removably fasten the bracket to the tree trunk at the selected height;

a table member;

a bracket fixture secured to the table member so as to be exposed at the rear edge of the table member;

said bracket and said bracket fixture having respectively nestable surface features; and securement means for removably securing the bracket fixture to the bracket with said respective nestable surface features in a nested condition, so that the table member is cantilevered out from the tree at the selected height.

2. The portable tree table of claim 1, wherein:

the nestable surface features are constituted by respective vertically oriented L-shaped channel members.

3. The portable tree table of claim 1, wherein:

said bracket includes means providing a rearwardly opening recess;

the means for connecting the bracket with the belt means comprising a U-bolt having a body received in said recess and two threaded legs extending horizontally forwardly through means defining two respective vertically aligned horizontal openings through said bracket, and nut means screwed onto said legs, in front of said bracket, the belt being threaded between the U-bolt body and the bracket.

4. The portable tree table of claim 3, wherein:

said recess is so deep, that if the belt is tightened about the tree trunk while the nut means are loose, and then the nut means are tightened, the belt is caused to encirclingly grip the tree more tightly by being cinched into the recess by the body of the U-bolt.

5. The portable tree table of claim 3, wherein:

said bracket fixture includes means providing a horizontally directed opening therethrough which is sized and placed to fit over one of said legs of said U-bolt, and one of said nut means provides said securement means.

6. The portable tree table of claim 1, further including:

at least one footed leveler screw threadedly mounted to the bracket so as to be projectable horizontally rearwardly therefrom to an adjustable degree, at a level that is vertically displaced from said securement means.

7. The portable tree table of claim 1, further including:

two footed leveler screws, each threadedly mounted to the bracket so as to be projectable horizontally rearwardly therefrom to an adjustable degree, at respective levels that are displaced vertically above and below said securement means.

8. The portable tree table of claim 1, wherein:

the nestable surface features are constituted by respective vertically oriented L-shaped channel members;

said channel member of said bracket having a rearwardly presented, vertically oriented trough side defining a rearwardly opening recess;

the means for connecting the bracket with the belt means comprising a U-bolt having a body received in said recess and two threaded legs extending horizontally forwardly through means of defining two respective vertically aligned horizontal openings through said bracket, and nut means screwed onto said legs, in front of said bracket, the belt being threaded between the U-bolt body and the bracket.

9. The portable tree table of claim 8, wherein:

said recess is so deep, that if the belt is tightened about the tree trunk while the nut means are loose, and then the nut means are tightened, the belt is caused to encirclingly grip the tree more tightly by being cinched into the recess by the body of the U-bolt.

10. The portable tree table of claim 9, further including:

two footed leveler screws, each threadedly mounted to the bracket so as to be projectable horizontally rearwardly therefrom to an adjustable degree, at respective levels that are displaced vertically above and below said securement means.

11. The portable tree table of claim 10, wherein:

said leveler screws are constructed and arranged to retractingly dispose said feet in said recess when said leveler screws are threaded out.

12. The portable tree table of claim 11, wherein:

said feet are flat-soled and rockably mounted on said leveler screws.

13. The portable tree table of claim 1, wherein:

said bracket fixture comprises an upright channel member disposed in means defining a notch located centrally of the table member in a rear edge of the table member;

said channel member having two forwardly diverging, horizontally extending support members secured thereto and underlyingly supporting said table member.

14. The portable tree table of claim 13, wherein:

the bracket fixture is secured to the table member by securement devices which secure the two support members to the underside of the table member.

15. The portable tree table of claim 1, further comprising:

a pair of stabilizer members which are laterally spaced from one another on laterally opposite sides of where said bracket fixture nests with said bracket;

each stabilizer member including:

a sleeve;

a bracket securing the sleeve on the underside of the table member;

a stabilizer bar slidingly mounted in the sleeve; and a set screw means on the sleeve which may be tightened to rigidly connect the stabilizer bar to the sleeve and loosened to permit the stabilizer bar to be slid in the sleeve, so that after the table member is mounted to the tree, the stabilizer bars may be slid forwards so that inner ends of the stabilizer bars engage the tree trunk, and the set screw means tightened, thereby preventing side-to-side tipping of the table member.

16. The portable tree table of claim 15, wherein:

the sleeves are tubular and the bars are tubular, but longer than the respective sleeves, so that both ends of each bar protrude from the respective ends of the respective sleeve;

the respective protruding tubular ends bar being crimped sufficiently to prevent the respective tubular bars from sliding out of the respective tubular sleeves in either direction even when the respective set screws are loosened.

17. The portable tree table of claim 15, wherein:

said bracket fixture comprises an upright channel member disposed in means defining a notch located centrally of the table member in a rear edge of the table member;

said channel member having two forwardly diverging, horizontally extending support members secured thereto and underlyingly supporting said table member;

the two stabilizer members being mounted near the rear edge of the table member respectively laterally outside the two diverging support members with said stabilizer bars being oriented so as to be generally parallel to the respective diverging support members.

* * * * *